US010253788B2

(12) United States Patent
Birkelund

(10) Patent No.: US 10,253,788 B2
(45) Date of Patent: Apr. 9, 2019

(54) EJECTOR ARRANGEMENT

(71) Applicant: Danfoss A/S, Nordborg (DK)

(72) Inventor: Michael Birkelund, Middelfart (DK)

(73) Assignee: Danfoss A/S, Nordborg (DK)

( * ) Notice: Subject to any disclaimer, the term of this patent is extended or adjusted under 35 U.S.C. 154(b) by 301 days.

(21) Appl. No.: 15/302,330

(22) PCT Filed: May 13, 2015

(86) PCT No.: PCT/EP2015/060599
§ 371 (c)(1),
(2) Date: Oct. 6, 2016

(87) PCT Pub. No.: WO2015/173305
PCT Pub. Date: Nov. 19, 2015

(65) Prior Publication Data

US 2017/0021369 A1 Jan. 26, 2017

(30) Foreign Application Priority Data

May 14, 2014 (EP) ..... 14168252

(51) Int. Cl.

| | |
|---|---|
| ***F04F 5/46*** | (2006.01) |
| ***F04F 5/54*** | (2006.01) |
| ***F04F 5/04*** | (2006.01) |
| *F25B 41/00* | (2006.01) |

(52) U.S. Cl.
CPC ..... *F04F 5/466* (2013.01); *F04F 5/04* (2013.01); *F04F 5/54* (2013.01); *F25B 41/00* (2013.01); *F25B 2341/0015* (2013.01)

(58) Field of Classification Search
CPC ..... F04F 5/466; F04F 5/54
See application file for complete search history.

(56) References Cited

U.S. PATENT DOCUMENTS

| | | | | |
|---|---|---|---|---|
| 1,071,875 A * | 9/1913 | Buschei | F04F 5/466 261/76 |
| 1,804,569 A * | 5/1931 | Taddiken | F04F 5/466 417/176 |
| 2,106,362 A | 1/1938 | Stalcup | |
| 2,126,384 A | 8/1938 | Haines | |

(Continued)

FOREIGN PATENT DOCUMENTS

| | | |
|---|---|---|
| CN | 2153666 Y | 1/1994 |
| CN | 2700569 Y | 5/2005 |

(Continued)

OTHER PUBLICATIONS

European Search Report for European Patent Application No. EP14168252 dated Sep. 10, 2014.

(Continued)

*Primary Examiner* — Peter J Bertheaud
(74) *Attorney, Agent, or Firm* — McCormick, Paulding & Huber LLP

(57) ABSTRACT

An ejector arrangement (1) is provided comprising a housing (5), at least two ejectors (2) arranged in said housing (5), each ejector (2) having a motive inlet (3), a suction inlet (29), an outlet (11) and a longitudinal axis (17). Such an arrangement should have a simple construction. To this end said suction inlet (29) of said ejectors (2) are connected by means of fluid paths to a common suction line (8).

21 Claims, 3 Drawing Sheets

(56) References Cited

U.S. PATENT DOCUMENTS

| | | | | |
|---|---|---|---|---|
| 2,159,251 | A | 5/1939 | Brizzolara | |
| 3,220,210 | A | 11/1965 | Rachfal et al. | |
| 3,369,375 | A * | 2/1968 | Gerweck ..... | A47F 3/0447 62/256 |
| 3,680,327 | A | 8/1972 | Stein | |
| 4,159,735 | A | 7/1979 | Anderson | |

FOREIGN PATENT DOCUMENTS

| | | | |
|---|---|---|---|
| CN | 202254492 | U | 5/2012 |
| DE | 344569 | C | 11/1921 |
| DE | 924122 | C | 2/1955 |
| EP | 1553364 | A2 | 7/2005 |
| JP | H11148733 | A | 6/1999 |
| JP | 2010014353 | A | 1/2010 |
| JP | 2010-151424 | A | 7/2010 |
| RU | 2415307 | C1 | 3/2011 |
| SU | 1195074 | A1 | 11/1985 |

OTHER PUBLICATIONS

International Search Report for PCT Serial No. PCT/EP2015/060599 dated Jun. 8, 2015.

* cited by examiner

EJECTOR ARRANGEMENT

CROSS REFERENCE TO RELATED APPLICATION

This application is entitled to the benefit of and incorporates by reference subject matter disclosed in the International Patent Application No. PCT/EP2015/060599 filed on May 13, 2015 and European Patent Application No. 14168252.6 filed on May 14, 2014.

TECHNICAL FIELD

The present invention relates to an ejector arrangement comprising a housing, at least two ejectors arranged in said housing, each ejector having a motive inlet, a suction inlet, an outlet, and a longitudinal axis, the motive inlets of said ejectors being connected to a common motive line.

BACKGROUND

Such an ejector arrangement is known from JP 2010-14353 A.

Generally speaking, an ejector is a type of pump that uses the Venturi effect to increase the pressure energy of the fluid at the suction inlet by means of a motive fluid supplied via the motive inlet. An ejector can also be termed as injector.

A single ejector has a limited capacity with respect to the amount of fluid per time. If a greater capacity is required, it is known to use more than one ejector. However, this makes the construction of an ejector arrangement complicated.

SUMMARY

The object underlying the invention is to have a simple construction of an ejector arrangement.

This object is solved with an ejector arrangement as mentioned above in that said suction inlets of said ejectors are connected by means of fluid paths to a common suction line.

In this case the motive fluid can be supplied to the motive inlet via the motive line and the suction fluid can be supplied to the suction inlet via the suction line which is common for the at least two ejectors. In this case both fluids can be guided in a controlled way. This makes the construction of the ejector arrangement simple and avoids losses due to an uncontrolled path of fluid to the suction inlet.

Preferably, said motive line and said suction line are arranged parallel to each other. This gives the possibility to simplify the arrangement further. The motive line and the suction line can be formed as parallel ducts or channels in the housing. When the ducts or channels are arranged in parallel, they can be drilled into the housing without complicated machining.

Preferably, said outlets of said ejectors are connected to a common outlet line, said outlet line being in particular arranged in parallel to at least one of said motive line and said suction line. When a common outlet line can be used, the fluid which is brought to a higher pressure energy can be collected from the ejectors and can be guided to an outlet port of the housing. In a preferred arrangement said outlet line is arranged in parallel to the motive line and/or to the suction line. This gives the same advantages as mentioned above for the arrangement of the suction line and the motive line. The output line, which can be formed as duct or channel as well, can be formed by drilling a hole into the housing which runs parallel to the hole drilled to form the motive line and/or the hole forming the suction line.

Preferably, said longitudinal axis is arranged perpendicular to at least one of said suction line and said outlet line. In this case the plurality of ejectors can be arranged with an optimum configuration with respect to the suction line and/or the outlet line. The fluid path for the suction fluid and/or for the outlet fluid can be kept short.

Preferably, said suction line is placed between said motive line and said outlet line. The result of this arrangement is a relatively compact housing.

In a preferred embodiment each ejector is placed within a cartridge, said cartridge being arranged in said housing. This simplifies mounting of the ejector arrangement. In a preferred embodiment said cartridge can comprise the ejector and the non-return valve and, if necessary, other components. These components can be pre-assembled in a separate production line. Thereafter, the cartridges can be mounted in said housing to assemble the ejector arrangement.

Preferably, said cartridge comprises a control valve controlling said motive inlet of said ejector. Such a valve can be, for example, an on/off solenoid valve. In this case, the motive inlet can, for example, be pulse modulated controlled.

In a preferred embodiment said control valve has a valve seat which is aligned with a motive nozzle of said ejector. Such an alignment reduces the pressure difference across the injector.

Preferably, said cartridge comprises an outlet channel, said outlet channel crossing said suction line. The outlet channel can run, for example, through a tube which is guided through the suction line. This gives the possibility to arrange the suction line and the outlet line within a common plane thus keeping the outer dimensions of the ejector arrangement small.

Preferably said cartridge comprises a non-return valve placed in said fluid path. In other words, the cartridge is a self-contained unit comprising all or at least almost all elements necessary for the function of the ejector.

In a preferred embodiment said fluid path from said suction line to said suction inlet comprises a 90° turn leaving said suction line and a 180° turn entering said ejector. The ejectors can be placed one aside the other in a direction parallel to the lengthwise direction of the suction line. Suction fluid can be easily distributed from the suction line to the plurality of ejectors.

In a preferred embodiment said non-return valve is placed in said fluid path, in particular between said 90° turn and said 180° turn. Said non-return valve prevents fluid with increased pressure to expand back into the suction line. In the preferred embodiment in which the non-return valve is arranged between said 90° turn and said 180° turn, there is enough space to accommodate valve element of the non-return valve.

Preferably, said non-return valve is placed symmetrically around said longitudinal axis. In this case it is possible to form the fluid path in a ring-shaped manner. This gives enough cross-section for the suction fluid so that the throttling resistance can be kept small. Nevertheless, the non-return valve is able to block a path back from the ejector into the suction line.

In a preferred embodiment said suction line and said outlet line are connected to each other by means of a bypass-valve. Such a bypass-valve can be a variable or fixed differential pressure bypass-valve, preferably a gas bypass-valve. Such a bypass valve allows for a reduction of the outlet pressure.

Preferably said bypass-valve has the same interface to said housing as an ejector. In other words, a cartridge and a bypass valve can be mounted at the same position in the housing without any further changes.

In a preferred embodiment at least one ejector is replaced by a dummy unit having the same interface to said housing as said ejector. Said dummy unit blocks the connection between the lines. Such a dummy unit can, for example, replace a defect ejector so that the ejector arrangement can operate with the remaining ejectors. The dummy unit can be used to adapt the capacity of the ejector arrangement to the needs of a user.

In a preferred embodiment said suction line comprises a gas suction inlet and a separate liquid suction inlet. In this case, not only gas can be sucked through the inlet suction and shifted to a higher pressure, but also a liquid can be sucked and pressure increased.

Preferably said suction line is divided in a gas section and a liquid section. This can simply be made by just interrupting the suction line between the gas section and the liquid section. Alternately said gas, e.g. vapor and liquid suction fluid can be combined in one piping before the connection to the housing and then enter the housing through a two-phase suction inlet. Ejectors connected to said two-phase suction can as options be equipped with rises for transportation separated liquid to a mixing chamber of the ejector.

In a preferred embodiment said housing comprises a monolithic structure. Such a monolithic structure can be formed by a block of material which is machined to form the channels and the cavities in which the ejectors are placed. A monolithic structure can be made stable enough for the required pressures.

Preferably at least two of said ejectors have different capacities. This gives the possibility to control the output of the ejector arrangement with a higher resolution.

BRIEF DESCRIPTION OF THE DRAWINGS

A preferred example of the invention will now be described in more detail with reference to the drawing, wherein.

DETAILED DESCRIPTION

Figure 1:
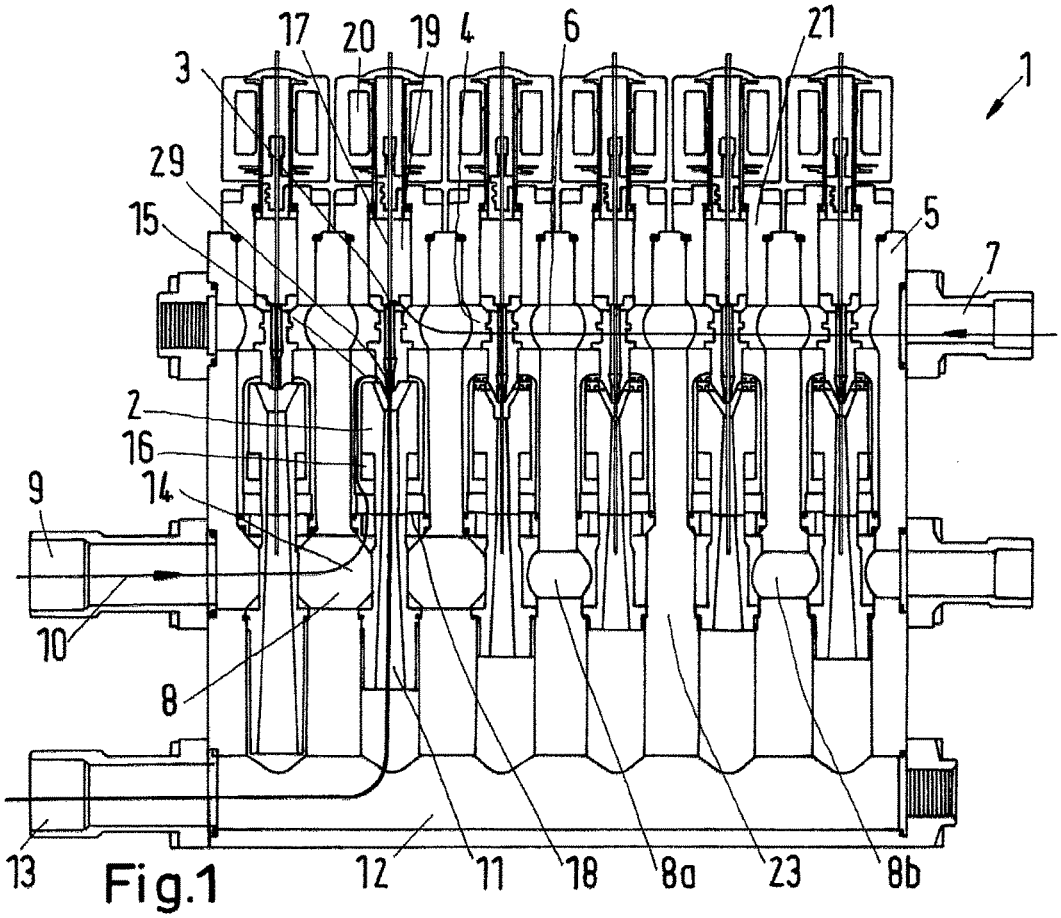
FIG. 1 is a sectional view of an ejector arrangement.
Figure 2:
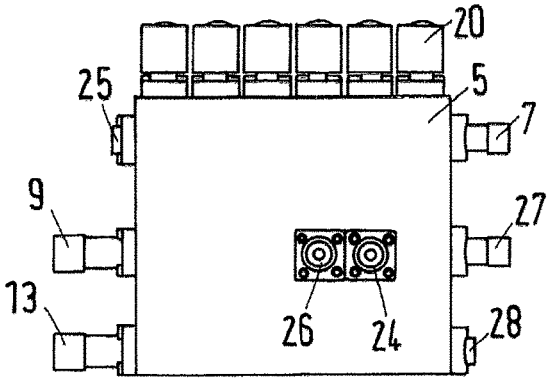
FIG. 2 is a front view of the ejector arrangement.
Figure 4:
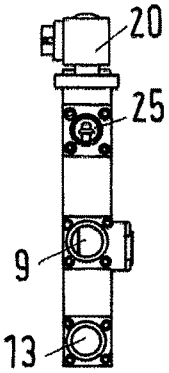
FIG. 4 is a side view of the ejector arrangement.
Figure 3:
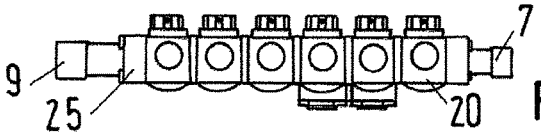
FIG. 3 is a top view of the ejector arrangement.

An ejector arrangement 1 comprises a plurality of ejectors 2, in the present example the ejector arrangement comprises six ejectors 2. Each ejector 2 has a motive inlet 3 which is connected to a motive line 4. The motive line 4 is formed by a channel drilled in a housing 5 which accommodates all ejectors 2. A flow path 6 for a motive fluid is shown. The motive fluid is supplied via a motive fluid supply port 7 provided at the housing 5.

A suction line 8 common to all ejectors 2 is provided in the housing 5 as well and opens into an ejector via a suction inlet 29. Suction fluid is supplied via a suction fluid supply port 9. A flow path 10 for a suction fluid is shown with a line. The suction line 8 is a channel or duct drilled into the housing 5. The suction line 8 runs parallel to the motive line 4 within the housing 5. The motive line 4 and the suction line 8 are arranged in a common plane, at least the center axis of the two lines 4, 8 are arranged in a common plane.

Each ejector 2 has an outlet 11. The outlets 11 of all ejectors 2 are connected to a common outlet line 12. In a preferred embodiment this outlet line 12 is arranged in parallel to the motive line 4 and the suction line 8. The central axis of the motive line 4, of the suction line 8 and of the outlet line 12 are arranged in a common plane.

The outlet line 12 is connected to an outlet port 13 arranged at the housing.

The flow path 10 has a 90° turn 14 when the suction fluid leaves the suction line 8 and a 180° turn 15 when the flow path enters the ejector 2, i.e. at the suction inlet 29.

A valve element 16 of a non-return valve is arranged in the flow path 10 of the suction fluid. The valve element 16 is placed symmetrically around a longitudinal axis 17 of the ejector 2. The valve element is lifted off a valve seat 18 by a pressure differential caused by the suction fluid flowing along the flow path 10. It is closed, e.g. the valve element 16 is pressed against the valve seat 18, when the pressure downstream the valve element 16 is greater than the pressure in the suction line 8.

Figure 6:
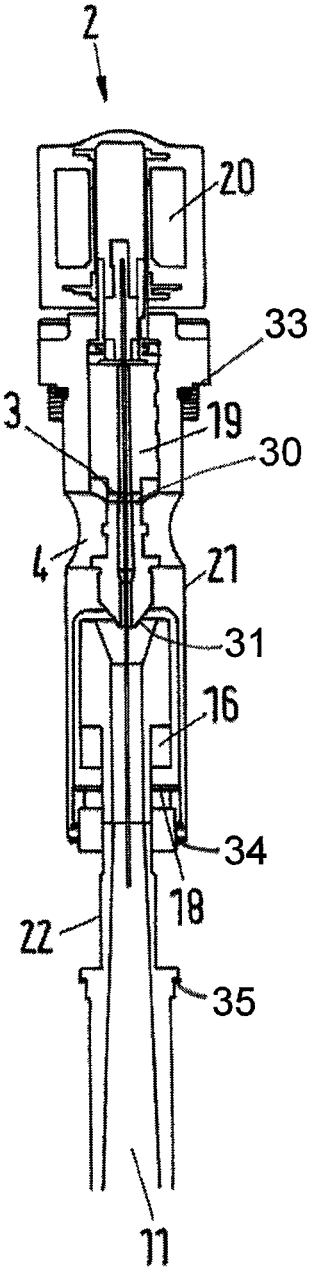
FIG. 6 is a sectional view of a cartridge according to FIG. 5.

Each ejector 2 is controlled by a control valve 19. The control valve 19 is driven by a solenoid 20. The control valve 19 can be an on/off-valve operated in a pulse modulated manner. The control valve 19 opens and closes the motive inlet 3. The control valve 19 comprises a valve seat 30 which is aligned with a motive nozzle 31 of the ejector 2 (FIG. 6). Such an alignment reduces the pressure difference across the ejector 2.

Each ejector 2 is assembled in a cartridge 21. The cartridge 21 comprises all elements of the ejector 2, e.g. the valve element 16 and the valve seat 18 of the non-return valve and the control valve 19 and the solenoid 20 controlling the motive inlet 3.

Figure 7:
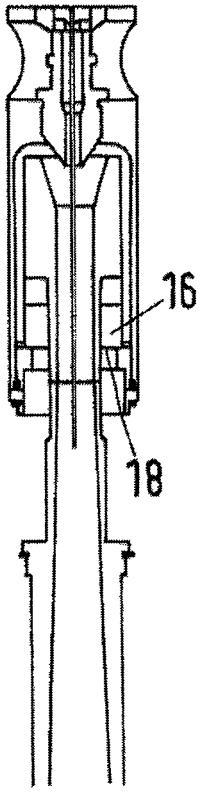
FIG. 7 is a sectional view according to FIG. 6 showing a closed non-return valve.

FIG. 6 shows a non-return valve 16, 18 in an open condition and FIG. 7 shows the non-return valve 16, 18 in a closed condition in which the valve element 16 rests against the valve seat 18.

Figure 5:
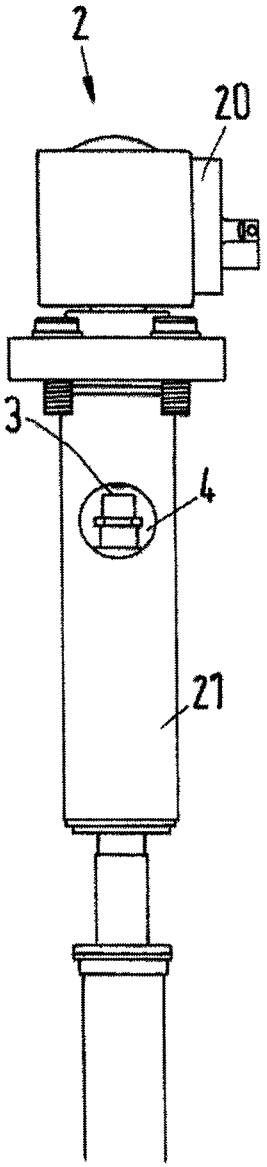
FIG. 5 shows a cartridge of a single ejector.

As can be seen in FIG. 5-7, the outlet 11 is arranged within a pipe 22. The pipe 22 crosses the suction line 8 (FIG. 1) so that it is possible to arrange the suction line 8 and the outlet line 12 in a common plane.

In FIG. 1 it can be seen that the suction line 8 is divided into sections 8*a*, 8*b* which are separated by a part 23 of the housing 5 forming a wall between sections 8*a*, 8*b*. Separation into sections 8*a*, 8*b* makes it possible to reserve one section 8*a* for the suction of a gaseous fluid and to use the other section 8*b* for a liquid fluid. The liquid fluid can be supplied via a liquid suction port 27. Furthermore, several auxiliary ports can be provided, i.e. a motive auxiliary port 25, a suction gas auxiliary port 26, a suction liquid auxiliary port 24 and a discharge auxiliary port 28. The auxiliary ports can, for example, be used as measuring ports or as service ports.

An ejector 2 handling liquid fluid can also handle gaseous fluid. Therefore, it is possible to introduce gaseous fluid not only in the section 8*a* but also into section 8*b*.

All cartridges 21 have the same outer dimensions so that the interface of all cartridges to the valve block is the same. However, the capacity of the ejectors 2 of different cartridges 21 can be different.

In a way not shown in the drawing, the suction line 8 and the outlet line 12 can be connected by means of a bypass-valve. Such a bypass-valve can be a gas-bypass valve with variable or fixed differential pressure. The bypass-valve and the cartridges 21 have the same interface to the housing 2.

Figure 8:
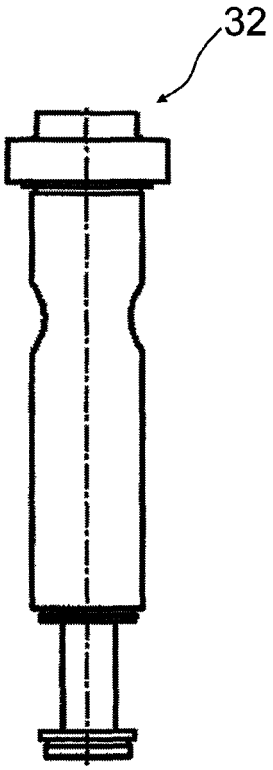
FIG. 8 is a side view of a dummy unit.
Figure 9:
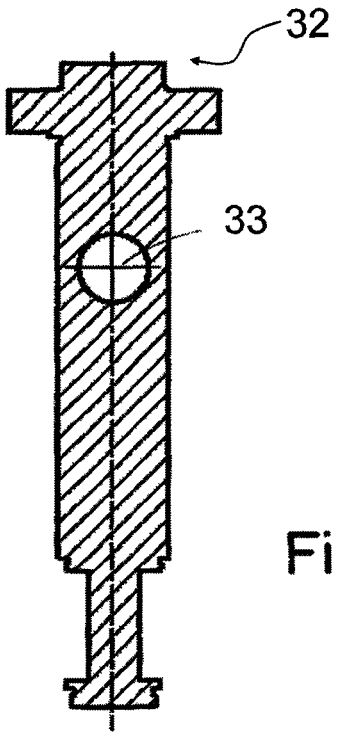
FIG. 9 is a sectional view of the dummy unit according to FIG. 8.
Figure 10:
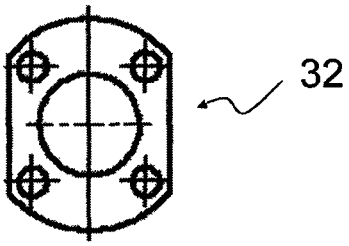
FIG. 10 is a top view of the dummy unit according to FIG. 8.

At least one of the ejectors 2 shown in FIG. 1 can be replaced by a dummy unit 32 shown in FIG. 8-10. The dummy unit 32 shows a bore 33 so that said dummy unit 32 does not interrupt the motive line 4 when inserted into the housing 5. However, as it comes out from FIG. 9, the dummy unit 32 does not have any further channels so that there is no connection between the motive line 4, the section line 8 and the outlet line 12 via the dummy unit 32. However, the dummy unit 32 has the same interface as the cartridge 21 so that an ejector 2 can be replaced by a dummy unit 32 without any problem. The dummy unit 32 can be used to replace a defect cartridge 21 if no other spare part is available. The dummy unit 32 can be used as well to adapt the capacity of the ejector arrangement 1 to the needs of a user.

As can be seen in FIG. 6, for example, the cartridge 21 has three axial seals 33, 34, 35. These axial seals come to rest against corresponding sealing faces within the housing 5. However, when the cartridge 21 is inserted into the housing 5, there is no frictional movement between the axial seals 33-35 and the housing 5.

The housing 5 is formed as a monolithic structure. The housing 5 can be made, for example, of a block of material, like steel or brass, in which the channels forming the lines 4, 8, 12 are drilled and in which further openings are drilled to accommodate the cartridges 21, said dummy unit 32 or any other element like the bypass-valve mentioned above.

In the present embodiment there have been shown two different ports for gas suction and liquid suction. However, gas and liquid suction can be combined in one piping before the connection to the housing and then enter through a two-phase suction.

Ejectors 2 connected to said two-phase suction can as options be equipped with raisers for transportation separated liquid to the liquid chamber of an injector 2.

The ejector 2 is not described in detail. Basically the ejector 2 has the motive fluid inlet 3 connected to a motive fluid nozzle. The suction inlet 29 of the ejector opens into a region in which the opening of the motive fluid nozzle opens as well. The combined flow of motive fluid and suction fluid enters a converging inlet nozzle which continues in a diverging outlet diffuser. The inlet nozzle and the outlet diffuser are connected by means of a diffuser throat. The converging-diverging nozzle accelerates the motive fluid which creates a low pressure zone that draws in and entrains the suction fluid. After passing through the diffuser throat of the ejector the mixed fluid expands and the velocity is reduced which results in recompressing the mixed fluids.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. An ejector arrangement comprising a housing, at least two ejectors arranged in said housing, each ejector having a motive inlet, a suction inlet, an outlet, and a longitudinal axis, the motive inlets of said ejectors being connected to a common motive line, wherein said suction inlets of said ejectors are connected by means of fluid paths to a common suction line, wherein each ejector is placed within a cartridge, each cartridge being arranged in said housing, and wherein each cartridge comprises a control valve controlling said motive inlet of each ejector within each cartridge.

2. The ejector arrangement according to claim 1, wherein said motive line and said suction line are arranged parallel to each other.

3. The ejector arrangement according to claim 1, wherein said outlets of said ejectors are connected to a common outlet line, said outlet line being arranged in parallel to at least one of said motive line and said suction line.

4. The ejector arrangement according to claim 3, wherein said longitudinal axis is arranged perpendicular to at least one of said suction line and said outlet line.

5. The ejector arrangement according to claim 3, wherein said suction line is placed between said motive line and said outlet line.

6. The ejector arrangement according to claim 1, said control valve preferably having a valve seat which is aligned with a motive nozzle of each ejector in each cartridge.

7. The ejector arrangement according to claim 1, wherein said cartridge comprises an outlet channel, said outlet channel crossing said suction line.

8. The ejector arrangement according to claim 1, wherein said cartridge comprises a non-return valve placed in a fluid path of said fluid paths.

9. The ejector arrangement according to claim 1, wherein a fluid path of said fluid paths from said suction line to said suction inlet comprises a 90° turn leaving said suction line and a 180° turn entering each ejector within each cartridge.

10. The ejector arrangement according to claim 1, wherein said common suction line and an outlet line are connected to each other by means of a bypass-valve.

11. The ejector arrangement according to claim 1, wherein at least one ejector is replaced by a dummy unit having the same interface to said housing as said at least one ejector.

12. The ejector arrangement according to claim 1, wherein said suction line comprises a gas suction inlet and a separate liquid suction inlet.

13. The ejector arrangement according to claim 1, wherein said housing comprises a monolithic structure.

14. The ejector arrangement according to claim 1, wherein at least two ejectors of said at least two ejectors have different capacities.

15. The ejector arrangement according to claim 2, wherein said outlets of said ejectors are connected to a common outlet line, said outlet line being arranged in parallel to at least one of said motive line and said suction line.

16. The ejector arrangement according to claim 4, wherein said suction line is placed between said motive line and said outlet line.

17. The ejector arrangement according to claim 9, wherein a non-return valve is placed between said 90° turn and said 180° turn.

18. The ejector arrangement according to claim 17, wherein said non-return valve is placed symmetrically around said longitudinal axis.

19. The ejector arrangement according to claim 10, wherein said bypass-valve has the same interface to said housing as an ejector.

20. The ejector arrangement according to claim 12, wherein said suction line is divided in a gas section and a liquid section.

21. An ejector arrangement comprising:

a housing;

a first ejector and a second ejector arranged in the housing;

wherein the first ejector includes a first motive inlet, a first suction inlet, a first outlet and a first longitudinal axis;

wherein the second ejector includes a second motive inlet, a second suction inlet, a second outlet and a second longitudinal axis;

wherein the first ejector and the second ejector are connected to a common motive line;

where the first suction inlet is connected to a common suction line by a first fluid path;

wherein the second suction inlet is connected to the common suction line by a second fluid path;

wherein the first ejector is arranged within a first cartridge;

wherein the second ejector is arranged within a second cartridge;

wherein the first cartridge and the second cartridge are arranged in the housing;

wherein the first cartridge comprises a first control valve configured to control the first motive inlet; and wherein the second cartridge comprises a second control valve configured to control the second motive inlet.

* * * * *